US010782107B1

(12) United States Patent
Dindl

(10) Patent No.: US 10,782,107 B1
(45) Date of Patent: Sep. 22, 2020

(54) LIGHTWEIGHT CARTRIDGE CASE AND WEAPON SYSTEM

(71) Applicant: U.S. Government as Represented by the Secretary of the Army, Picatinny Arsenal, Dover, NJ (US)

(72) Inventor: Frank Dindl, Newton, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 16/666,817

(22) Filed: Oct. 29, 2019

Related U.S. Application Data

(63) Continuation of application No. 15/587,727, filed on May 5, 2017, now abandoned, which is a continuation (Continued)

(51) Int. Cl.

| | |
|---|---|
| ***F42B 5/28*** | (2006.01) |
| ***F42C 19/08*** | (2006.01) |
| ***F42B 5/30*** | (2006.01) |
| ***F42B 5/26*** | (2006.01) |
| ***F41B 11/62*** | (2013.01) |
| ***F42B 5/02*** | (2006.01) |
| ***F41A 15/00*** | (2006.01) |

(Continued)

(52) U.S. Cl.

CPC ..... *F42B 5/28* (2013.01); *F41A 15/00* (2013.01); *F41A 15/04* (2013.01); *F41A 15/12* (2013.01); *F41A 21/28* (2013.01); *F41B 11/62* (2013.01); *F42B 5/02* (2013.01); *F42B 5/26* (2013.01); *F42B 5/30* (2013.01); *F42B 39/087* (2013.01); *F42C 19/083* (2013.01)

(58) Field of Classification Search

CPC ..... F42B 5/02; F42B 5/26; F42B 5/28; F42B 5/30; F42B 5/36; F42B 5/285; F42B 5/307; F42C 19/083

See application file for complete search history.

(56) References Cited

U.S. PATENT DOCUMENTS

| | | | | |
|---|---|---|---|---|
| 12,648 A | | 4/1855 | White | |
| 1,834,020 A | * | 12/1931 | Destree | F42B 5/26 102/469 |

(Continued)

FOREIGN PATENT DOCUMENTS

| | | | | |
|---|---|---|---|---|
| DE | 2852174 A1 | * | 6/1990 | F42B 5/182 |
| FR | 1385924 | | 3/1964 | |
| FR | 1385924 A | * | 1/1965 | C07C 17/281 |

OTHER PUBLICATIONS

Beretta, Berettal Pistol Model 21A, User Manual, 12-13, Beretta U.S.A. Corp., Accokeek, MD, USA.

*Primary Examiner* — Benjamin P Lee
(74) *Attorney, Agent, or Firm* — John P. DiScala

(57) ABSTRACT

The rifle system comprises a rifle and an ammunition round for operation with the rifle. The high pressure ammunition round further comprises a cartridge case having an outer wall wherein prior to firing of the ammunition round, the outer wall geometry of the cartridge case is devoid of features configured for interfacing with a mechanical extractor. The rifle further comprising a barrel chamber which fully supports a chambered cartridge case and a rear extraction mechanism for extracting a spent cartridge case through the rear of the barrel chamber.

9 Claims, 21 Drawing Sheets

Related U.S. Application Data of application No. 15/587,660, filed on May 5, 2017, now abandoned.

(60) Provisional application No. 62/334,620, filed on May 11, 2016.

(51) Int. Cl.

| | |
|---|---|
| ***F42B 39/08*** | (2006.01) |
| ***F41A 15/04*** | (2006.01) |
| ***F41A 21/28*** | (2006.01) |
| ***F41A 15/12*** | (2006.01) |

(56) References Cited

U.S. PATENT DOCUMENTS 2,925,015 A * 2/1960 Clark ..... F42B 39/08 89/35.01
3,099,958 A * 8/1963 Daubenspeck ..... F42B 7/06 102/449
3,352,240 A * 11/1967 Eckstein ..... F42C 19/10 102/470
3,485,170 A * 12/1969 Scanlon ..... F42B 5/02 102/432
3,609,904 A * 10/1971 Scanlon ..... F41A 15/04 42/76.01
3,656,434 A * 4/1972 Curran ..... B05B 7/1404 102/467
3,732,820 A * 5/1973 Hendricks ..... F42B 5/36 102/470
3,753,307 A * 8/1973 Usel ..... F41A 15/02 42/25
4,681,038 A * 7/1987 Washburn ..... F42B 5/26 102/430
5,048,423 A * 9/1991 Garrett ..... F42B 5/045 102/430
5,173,571 A * 12/1992 Montgomery ..... F42B 5/045 102/434
5,388,522 A * 2/1995 Martwick ..... F42B 5/045 102/434
5,481,978 A * 1/1996 Muller ..... F42B 5/36 102/430
5,758,445 A 6/1998 Casull
6,959,647 B2 * 11/2005 Reynolds ..... F42B 5/26 102/430
7,841,279 B2 11/2010 Reynolds
7,877,918 B2 2/2011 Garavaglia
8,156,870 B2 * 4/2012 South ..... F42B 5/26 102/464
8,240,252 B2 8/2012 Maljkovic
8,522,684 B2 * 9/2013 Davies ..... F42B 5/26 102/466
8,813,650 B2 8/2014 Maljkovic
8,850,985 B2 10/2014 Maljkovic
8,850,986 B1 * 10/2014 Alalati ..... F42B 5/02 102/470
9,188,412 B2 11/2015 Maljkovic
9,335,137 B2 5/2016 Maljkovic
9,528,799 B2 12/2016 Maljkovic
9,829,289 B1 * 11/2017 Burke ..... F42C 19/0807
9,869,536 B2 * 1/2018 Burrow ..... F42B 33/001
2002/0189486 A1 12/2002 Westrom
2004/0069175 A1 * 4/2004 Attarwala ..... F42B 5/36 102/438
2005/0005807 A1 * 1/2005 Wiley ..... F42B 12/745 102/517
2006/0207464 A1 9/2006 Maljkovic
2007/0214992 A1 * 9/2007 Dittrich ..... F42B 5/36 102/469
2016/0003585 A1 * 1/2016 Carpenter ..... F42B 5/02 102/430
2017/0030692 A1 * 2/2017 Drobockyi ..... F42B 33/001
2017/0115105 A1 * 4/2017 Burrow ..... F42C 19/083
2017/0261298 A1 * 9/2017 Palo ..... F42C 19/04

* cited by examiner

Prior Art FIG. 1

LIGHTWEIGHT CARTRIDGE CASE AND WEAPON SYSTEM

CROSS-REFERENCE TO RELATED APPLICATIONS

This application is a continuation of U.S. patent application Ser. No. 15/587,727 filed on May 5, 2017 which is itself a continuation of U.S. patent application Ser. No. 15/587,660 filed on May 5, 2017, both of which claim the benefit under 35 USC § 119(e) of U.S. provisional patent application 62/334,620 filed on May 11, 2016.

STATEMENT OF GOVERNMENT INTEREST

The inventions described herein may be manufactured, used and licensed by or for the United States Government.

BACKGROUND OF THE INVENTION

The invention relates in general to small arms weapons and in particular to cartridge cases for small arms.

Centerfire ammunition cartridges have changed little since the 8 mm Lebel cartridge, developed in 1886, ushered in the modern era of high pressure centerfire cartridges. The evolution to the 8 mm Lebel ammunition cartridge began with the original design of a self-contained cartridge developed by Samuel Pauly and Francois Prelat in 1808 and includes the development of pin fired cartridges by Casmir Lefaucheux in 1836 and the breech loading Sharps rifle of the Civil War which initially fired paper cartridges but later adopted to fire self-contained metallic cartridges. Widespread adoption of self-contained metallic cartridge followed the development of the Smith & Wesson Model 1 revolver in 1857. In 1867, the Eley-Boxer metallic centerfire cartridge case adopted by the British military. The 8 mm Lebel was the first cartridge using smokeless propellant to be made and adopted by any country.

Centerfire cartridges have changed little since these early developments. High power centerfire cartridges have used relatively thick, heavy cartridge case heads to support the firing loads. Most cartridge cases are made of heavy brass for this reason. Case head designs relying on mechanical extraction of the cartridge case require that the rearmost portion of the cartridge case extend beyond the rear of the chamber where they are largely unsupported. This, typically, limits peak chamber pressures to below 60,000 pounds per square inch (psi). High power centerfire cartridge cases constitute the majority of the weight of the complete cartridge.

Conventional ammunition includes a cartridge case 101, a projectile 103, a propellant 105 and a primer 107. Prior art FIG. 1 shows a conventional 5.56 NATO ammunition round known in the prior art. The 5.56 NATO ammunition round is the standard cartridge for NATO military forces as well other non-NATO military forces and is exemplary of the features and drawbacks of conventional ammunition.

The cartridge case 101 of the 5.56 NATO ammunition round is made of brass and the entire ammunition round weighs approximately 190 grains or 12.3 grams without any links for belt feeding. The cartridge case 101 accounts for a majority of this weight. The cartridge case 101 is a tapered bottleneck case type having a neck region 109, a shoulder region 111, a body region 113 and a head region 115. The head region includes an extractor groove 117 and rim 119 for interfacing with a conventional extraction mechanism.

As illustrated by the 5.56 NATO ammunition round, the thickness of the head region 115 is substantially thicker than the thickness of the other regions of the cartridge case 101 due to both the need for the extraction features 117 in the case 101 and because the head region 115 of the case 101 is unsupported in the barrel. As the head 115 of the case 101 is unsupported, the material properties of the cartridge case 101 must be sufficient to withstand the firing load. The thicker head 115 adds additional size and weight to the cartridge case 101.

The primer 107 is inserted into a cavity formed in the head 115 of the cartridge case 101. The primer 107 also adds weight to the ammunition 10 and takes up volume within the cartridge case 101. Additionally, the seam between the primer 107 and the cartridge case 101 may leak thereby causing performance issues with the ammunition round 2.

A need exists for an improved ammunition cartridge which is lighter, less expensive, safer and can operate at higher chamber pressures than conventional ammunition.

SUMMARY OF INVENTION

One aspect of the invention is a rifle system. The rifle system comprises a rifle and an ammunition round for operation with the rifle. The high pressure ammunition round further comprises a cartridge case having an outer wall wherein prior to firing of the ammunition round, the outer wall geometry of the cartridge case is devoid of features configured for interfacing with a mechanical extractor. The rifle further comprising a barrel chamber which fully supports a chambered cartridge case and a rear extraction mechanism for extracting a spent cartridge case through the rear of the barrel chamber.

A second aspect of the invention is a rifle for firing high pressure ammunition. The rifle includes a barrel chamber which fully supports a chambered cartridge case and a rear extraction mechanism for extracting a spent cartridge case through the rear of the barrel chamber.

A third aspect of the invention is an ammunition round. The high pressure ammunition round further comprises a cartridge case having an outer wall wherein prior to firing of the ammunition round, the outer wall geometry of the cartridge case is devoid of features configured for interfacing with a mechanical extractor.

The invention will be better understood, and further objects, features and advantages of the invention will become more apparent from the following description, taken in conjunction with the accompanying drawings.

BRIEF DESCRIPTION OF THE DRAWINGS

In the drawings, which are not necessarily to scale, like or corresponding parts are denoted by like or corresponding reference numerals.

Prior Art

DETAILED DESCRIPTION

Figure 1:
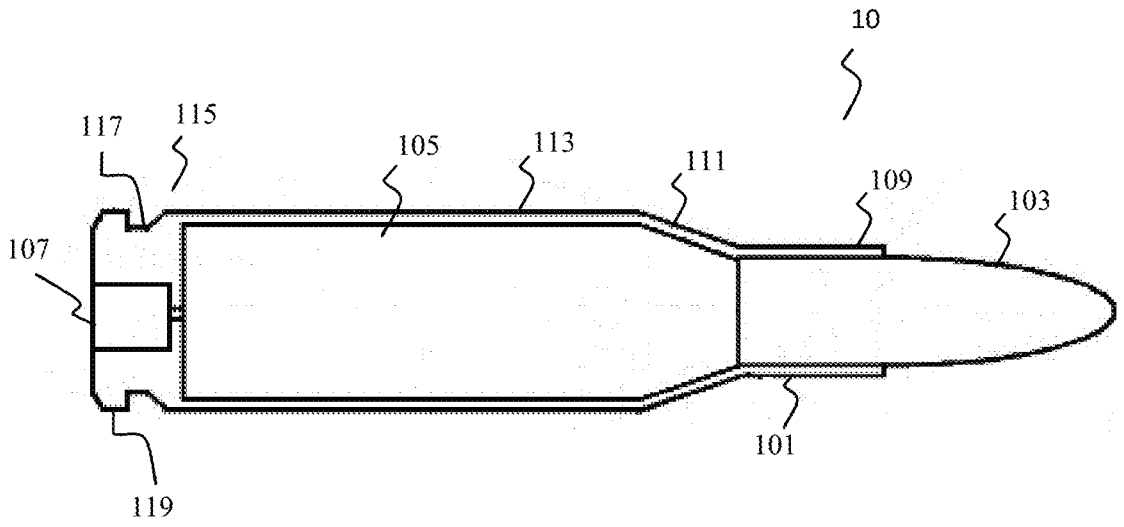
FIG. 1 is a cross sectional view of a standard NATO 5.56 mm ammunition round, in accordance with one illustrative embodiment.

A rifle system having a rifle and accompanying ammunition allows for ammunition with a reduced weight cartridge case. The reduced weight of the cartridge case may lower the load on the soldier or may increase the performance of the rifle by allowing for more propellant to be included in an ammunition round.

Rifle, as used throughout this specification refers to a firearm which operates with peak chamber pressures in the range of approximately 40,000 to 190,000 pounds per square inch. The rifle may fire a single projectile or may fire projectiles in an automatic or semi-automatic firing mode. Additionally, the rifle may be either magazine fed or belt fed. As an example, conventional rifles which may be modified for use in the rifle system include the 5.7 mm P90, 5.56 mm M4, 5.56 mm M16/AR15, 7.62 mm M40 or M24 sniper rifles, .50 caliber M82A1/M107, 14.5 mm, 20 mm, 5.56 mm M249, 7.62 mm M240, .50 caliber M2, 20 mm M61, 25 mm M242, 30 mm GAU-8 and MK44, Bushmaster III 35/50 mm, 40 mm Bushmaster IV, 40 mm Bofors L/70, and Bofors 57 mm and other rifle calibers. However, the rifle isn't limited to modified versions of existing rifles.

The rifle includes a rear extraction mechanism which doesn't rely on an extractor groove as is typical of conventional centerfire cartridges. By eliminating the conventional extractor from the rifle, the barrel chamber may be modified to fully support the base of an ammunition round chambered in the rifle.

The ammunition round is suited for peak chamber pressures in the range of approximately 40,000 to 190,000 psi. More specifically, the ammunition round is particularly suited for peak chamber pressures in the range of approximately 50,000 to 150,000 psi. The lightweight ammunition round described herein may provide the equivalent functionality of conventional ammunition in a range of calibers. For example, the modified lightweight ammunition round may be a modified equivalent of the ammunition associated with the above listed firearms.

The ammunition round is devoid of the extractor groove found in traditional ammunition. Additionally, as the cartridge case is fully supported within the barrel, the cartridge case does not have to support the full firing load experienced during firing of the ammunition round.

Advantageously, the cartridge case is lighter than most conventional cartridge cases. The cartridge case requires less material to be used due to having thinner walls and the amount of head material being reduced. Additionally, alternative materials such as aluminum, steel or polymer materials may be used for the cartridge case as the full firing load is no longer supported by the cartridge case.

Weight reductions in the range of approximately 50% may be achieved over equivalent conventional ammunition. For example, as will be described in further detail below, in one embodiment in which a polymer case is employed, a belt fed modified lightweight 5.56 mm M855A1 ammunition round weighs approximately 96.3 grains whereas a belt fed conventional 5.56 mm M855A1 ammunition round weighs approximately 222 grains.

As the full support of the case addresses chamber pressure limitations associated with conventional ammunition, the lightweight cartridge case may be configured to operate at higher chamber pressures of the rifle to reduce the amount of propellant required to achieve a given muzzle velocity. Alternatively, the reduced weight and volume of the cartridge case may allow for the use of more propellant in the same weight and size profile of conventional ammunition thereby increasing performance.

In another embodiment, the lightweight ammunition rounds may include lightweight projectiles with high density penetrators to further reduce cartridge weight while providing increased lethality and armor penetration at short ranges due to the increased muzzle velocities associated with using lightweight projectiles.

A primer cup may be formed integrally to the cartridge case further reducing the volume and weight of the cartridge case. By having an integral primer cup and cartridge case, the ammunition round is more safe and robust as the seam between the primer cup and the cartridge case is eliminated.

Additionally, eliminating this seam eliminates the "burn-through" failure mode associated with conventional high power cartridges with aluminum cases.

Additional safety features may be realized due to the case being fully supported. The risk of cook off is significantly reduced. During cook-off, the greatest hazard to the operator of the weapon is when the cartridge is partially chambered but the bolt is not locked. A conventional cartridge case ruptures at a high pressure due to the strength required by conventional cases. However, the relatively thin walls of the lightweight ammunition cartridge rupture at much lower and less hazardous pressure. Additionally, the hazard from fragments is lowered due to the lightweight, thin walled cartridge case failing at lower pressures and producing lower kinetic energy fragments compared to conventional brass cased cartridges.

Figure 2:
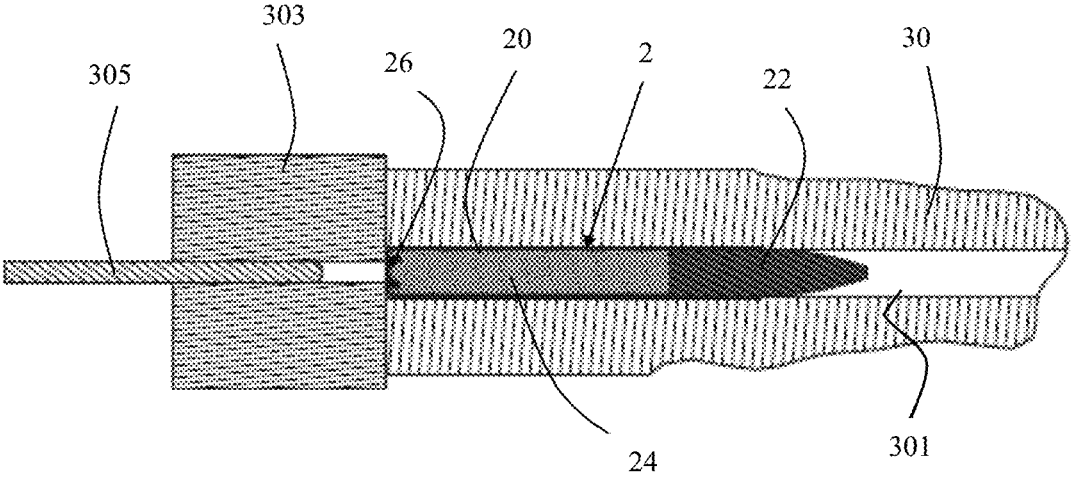
FIG. 2 is a sectional plan view of the rifle system in a chambered position, in accordance with one illustrative embodiment.

FIG. 2 is a sectional plan view of the rifle system in a chambered configuration, in accordance with one illustrative embodiment. The rifle system includes a rifle 30 and an ammunition round 2. As shown, the rifle system is in a chambered configuration with an ammunition round 2 chambered in the barrel 301 of the rifle 30. The ammunition round 2 may be fed into the chamber 301 from a magazine using magazine feeding means known in the art. Alternatively, as will be described in further detail below, the ammunition round 2 may be belt-fed into the chamber.

The ammunition round 2 comprises a cartridge case 20, a primer 26 and a propellant charge 24 housed within the cartridge case 20 and a projectile 22 secured to a forward end of the cartridge case 20. As will be described in further detail below, in the embodiment shown, a primer composition 261 is secured inside the base 205 of the cartridge case 20 by the cartridge case 20 and the propellant charge 22 forming a primer cup 263. The propellant charge 22 shown in FIG. 2 is a consolidated propellant charge 22 which serves as an anvil 265 to ignite the primer composition 26. Alternatively, an anvil 265 may be inserted between the propellant charge 22 and the primer composition 26.

In a chambered configuration, the cartridge case 20 is seated in the chamber 301 of the barrel 301. An inner surface of the barrel chamber 301 supports the entire length of the cartridge case 20 in the chamber, particularly including the region preceding the base of the cartridge case 20. A bolt 303 of the rifle 30 is seated against an outer surface of the base 205 of the cartridge case 20. A firing pin 305 of the rifle 30 is slidably disposed within the bolt 303.

Figure 3:
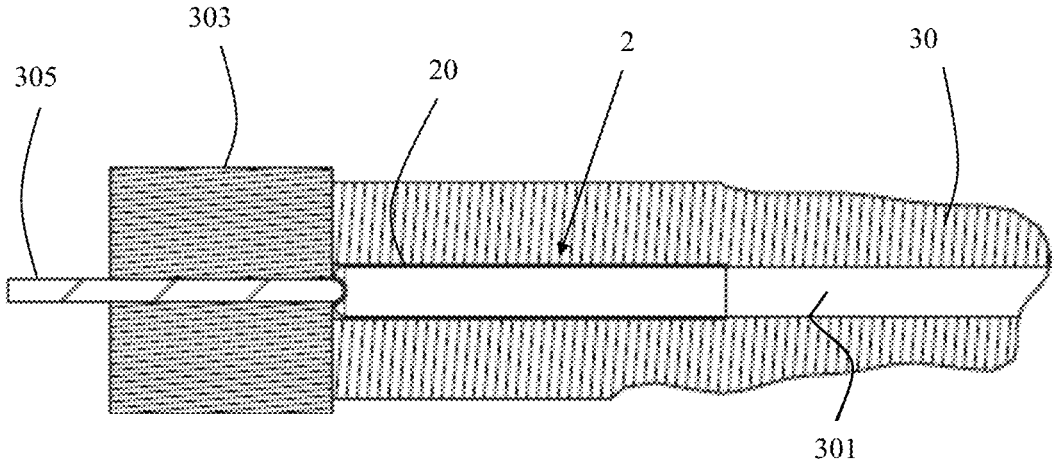
FIG. 3 is a sectional plan view of the rifle system in a firing position, in accordance with one illustrative embodiment.

FIG. 3 is a sectional plan view of the rifle system in a firing configuration, in accordance with one illustrative embodiment. To fire the ammunition round 2, the firing pin 305 strikes the base 205 of the cartridge case 20 thereby indenting the cartridge case 20. The primer composition 261 is pinched between the indented cartridge case 20 and the anvil 265 of the propellant which initiates the primer composition 261. Hot gases produced by the primer composition 261 reaction ignites the propellant charge 22. Hot, high pressure gases pressure the chamber 301 and propel the projectile 22 thru a bore of the barrel 301.

Figure 4:
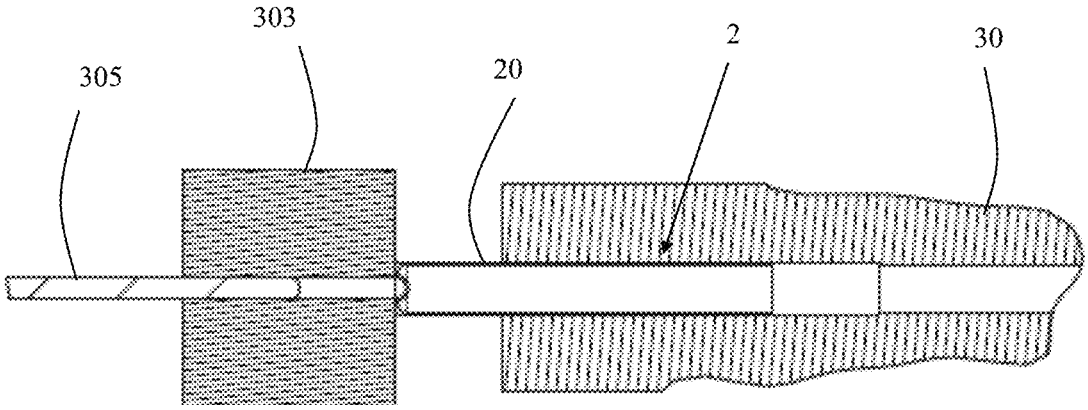
FIG. 4 is a sectional plan view of the rifle system in an extraction position, in accordance with one illustrative embodiment.

FIG. 4 is a sectional plan view of the rifle system in an extraction position, in accordance with one illustrative embodiment. Subsequent to firing the ammunition round 2, the bolt 303 moves rearward. As the bolt 303 translates rearward, the fired cartridge case 20 is held against the bolt 303 by the residual pressure in the bore of the barrel 301. As the cartridge case 20 travels rearward with the bolt 303, an ejector engages the fired cartridge case 20 and redirects the cartridge case 20 out of an ejection port of the rifle 30. Muzzle devices, such as conventional muzzle suppressors may be used to boost the duration and pressure of the residual bore pressure during case extraction.

Figure 5:
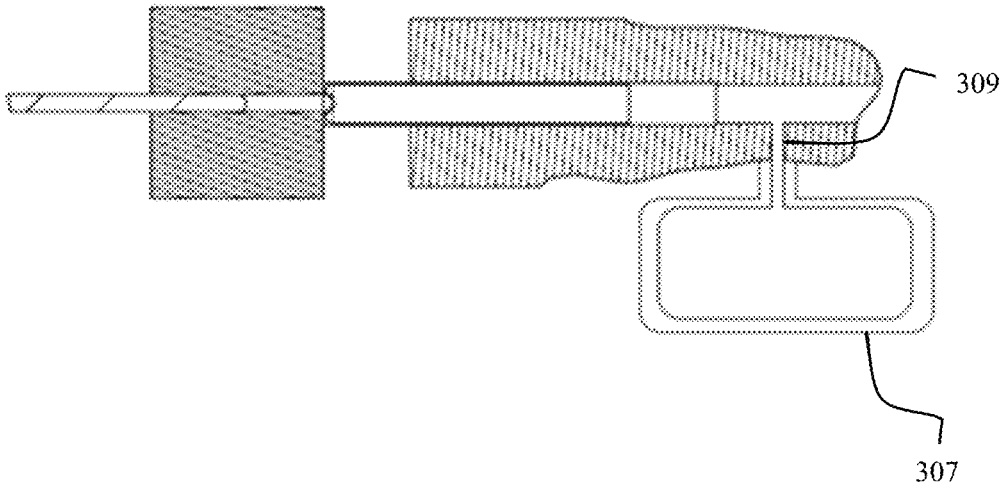
FIG. 5 is a sectional plan view of a rifle comprising a gas extraction mechanism, in accordance with one illustrative embodiment.

FIG. 5 is a sectional plan view of a rifle comprising a gas extraction mechanism, in accordance with one illustrative embodiment. The duration and pressure of the residual bore pressure may be adjusted by trapping propellant gases during firing. Trapped propellant gases may then be reintroduced to the bore after firing to assist in extraction of the case. Alternatively, compressed gases from an external source may be introduced into the bore subsequent to firing to assist in ejection of the cartridge case 20. The trapped gases may be stored in a gas housing 307 such as a cylinder or reservoir which is mounted to the barrel 301 and contains an inlet 309 to the bore of the barrel 301.

Figure 6:
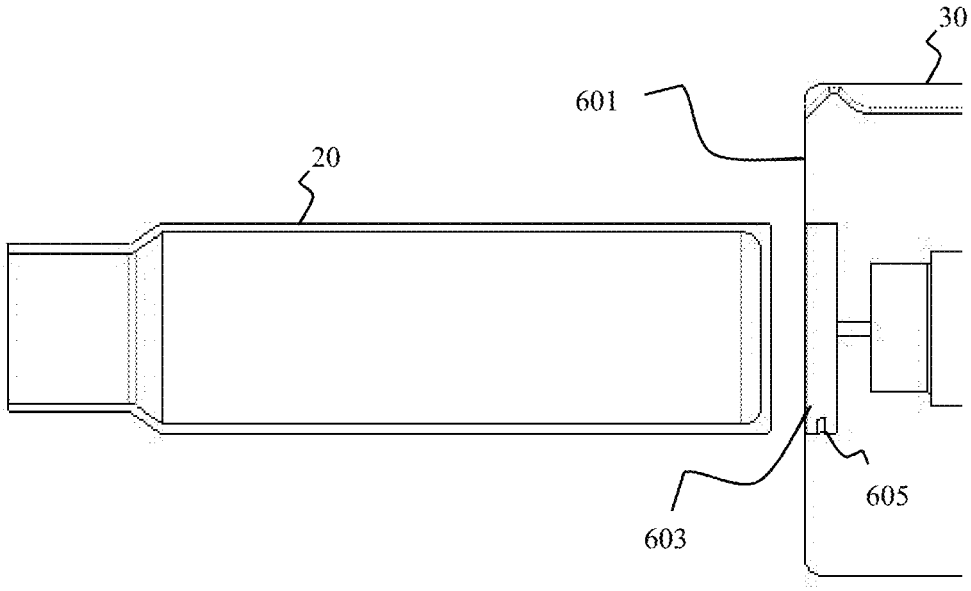
FIG. 6 is a cutaway perspective view of the barrel chamber of the rifle comprising a recessed bolt extraction mechanism and a cartridge case in an uncaptured state, in accordance with one illustrative embodiment.

FIG. 6 is a cutaway perspective view of the barrel chamber of the rifle comprising a recessed bolt extraction mechanism in an uncaptured position, in accordance with one illustrative embodiment. In an alternative embodiment, the rifle 30 comprises a dynamically formed extractor. In this embodiment, the bolt 303 comprises a recess 603 defined by the face 601 of the bolt 303. The recess 603 is sized and dimensioned to receive a rear portion of the cartridge case 20 when pressed against the cartridge case 20. The recess 603 further comprises an undercut 605, such as a tapered undercut, defined by an inner circumferential surface of the recess 603.

Figure 7:
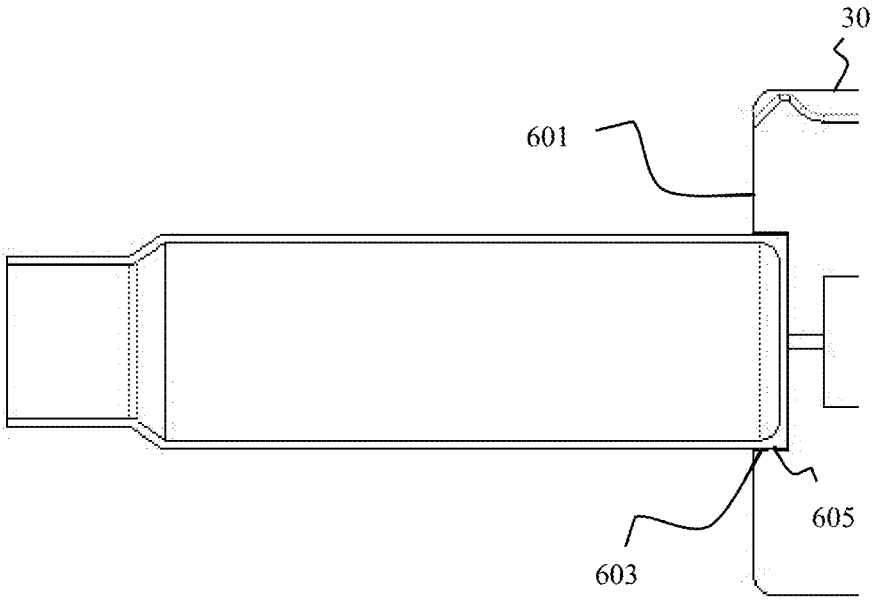
FIG. 7 is a cutaway perspective view of a barrel chamber of the rifle comprising a recessed bolt extraction mechanism and a cartridge case in a captured state, in accordance with one illustrative embodiment.

FIG. 7 is a cutaway perspective view of the barrel chamber of the rifle comprising a recessed bolt extraction mechanism and a cartridge case in a captured position, in accordance with one illustrative embodiment of the invention. In a chambered configuration of the rifle 30 system, the rear portion of the cartridge case 20 is received within the recess 603 with the recess 603 surrounding the rear portion. Upon firing of the ammunition round 2, the thin walled cartridge case 20 expands into the undercut 605 thereby dynamically forming an extraction feature in the case. As the bolt 303 travels rearward, the cartridge case 20 is pulled along until interfacing with an ejector (not shown). The dynamically formed extractor may be employed in lieu of gas extraction of the cartridge case 20 or used in conjunction with gas extraction of the cartridge case 20.

In an alternative embodiment, an interference extractor provides the extraction force on the cartridge case 20. The interference extractor engages with the cartridge case 20 via an interference fit. The interference extractor pushes along the outer circumferential surface of the cartridge case 20 during feeding and chambering and provides adequate grip to extract the fired or unfired case. Advantageously, with such an interference extraction mechanism, both fired and unfired cartridge cases may be removed. An interference extractor is particularly suited for use with polymer cartridge cases.

Figure 8:
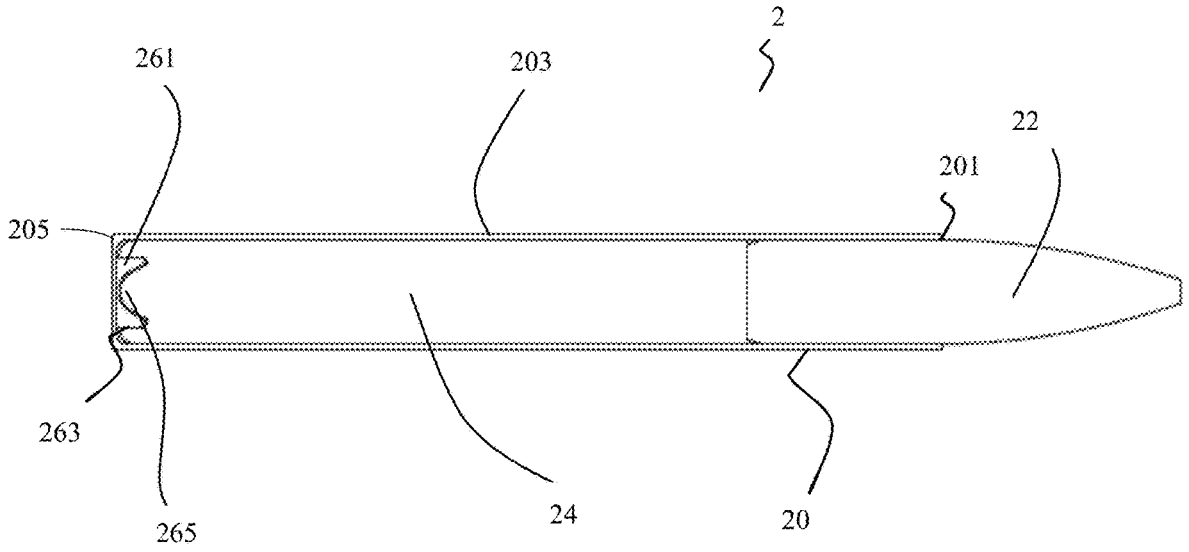
FIG. 8 is sectional plan view of a cartridge case with a consolidated propellant charge serving as the primer cup and anvil, in accordance with one illustrative embodiment.

FIG. 8 is sectional plan view of a cartridge case with a consolidated propellant charge serving as the primer cup and anvil 265, in accordance with one illustrative embodiment. The exemplary ammunition round 2 shown in FIG. 8 comprises a cartridge case 20, primer composition 26, propellant charge 22 and a projectile 22. The cartridge case 20 shown in FIG. 8 is a cylindrical straight-walled cartridge case 20. The straight-walled cartridge case 20 is particularly suited for use with consolidated propellant charges as the straight walls do not impede the insertion of the propellant charge into the cartridge case 20. However, in other embodiments, such as those embodiments which do not employ a consolidated primer charge, the walls are not straight and include a neck region and a shoulder region.

The cartridge case 20 shown in FIG. 8 comprises a cylindrical body region 203 extending from the case mouth 201 to the base 205 of the cartridge case 20. A base 205 of the cartridge case 20 is integral with the cylindrical body 203 of the cartridge case 20 and is of substantially the same thickness as the body 203 of the cartridge case 20. The cartridge case 20 does not include a head region or rim and is devoid of any extractor features, such as the extractor groove, found on conventional ammunition.

The walls of the cartridge case 20 are of substantially the same thickness along the entire axial length of the body 203. In comparison to conventional ammunition, the walls of the cartridge case 20 are relatively thin. In particular, the absence of the thicker head region and base 205 reduces the volume of case material required for the cartridge case 20.

Accordingly, as the head region and extraction features are eliminated and the cartridge case 20 walls are thinner, the cartridge case 20 is lighter. Additionally, the reduction in material allows for the lightweight ammunition round 2 to achieve the same performance as an equivalent conventional ammunition in a smaller profile round. Alternatively, the lightweight ammunition round 2 may have the same outer profile as an equivalent conventional ammunition with more volume available in the interior cavity. This additional volume may be utilized to increase performance by including more propellant in the round.

To further reduce cartridge weight, the ammunition round 2 may be made of lighter and cheaper materials than conventional ammunition. As the ammunition round 2 is fully supported within the chamber, materials with the strength of brass are not required. For example, the ammunition cartridge may be made of steel, aluminum or a polymer material. The polymer material may be a sulfone polymer material such as Radel® polyphenylsulfone (PPSU) material available from Sulvay S.A. located in Neder-Over-Heembeek, Brussels, Belgium. However, the ammunition cartridge is not limited to being made of steel, aluminum or polymer. The cartridge case 20 may be made of any material suitable to withstand chamber pressures in the ranges specified above.

The body 203 and base 205 together define an interior cavity of the cartridge case 20 with an opening at the mouth 201 of the cartridge case 20. A projectile 22 is inserted into the interior cavity of the cartridge case 20. Primer composition 261 and a propellant charge 22 fill the remaining volume of the cavity.

In the embodiment shown, the propellant charge 22 is a consolidated propellant charge 22 which serves to secure the primer composition 261 within the interior cavity as well as to serve as the anvil 265 for initiating the primer composition 26. The consolidated propellant charge 22 comprises a cavity for receiving the primer composition 261 formed in a bottom surface of the charge. The bottom surface of the consolidated propellant charge 22 is in communication with the primer composition 261 and is of sufficient strength to serve as the anvil 265. In alternative embodiments of the invention, an external anvil 265 may be inserted into the inner cavity and between the propellant charge 22 and the primer composition 261. Additionally, the propellant is not limited to consolidated propellants. The propellant may be compacted in the cartridge case 20, as well.

In addition to the weight reductions and performance enhancements achieved through the cartridge case 20 dimensions and material properties, as the cartridge case 20 is fully supported within the chamber, the rifle 30 and ammunition round 2 may be configured to operate at higher chamber pressures. Accordingly, less propellant may be required in the lightweight ammunition round 2 to achieve the same results as conventional ammunition. This serves to further reduce the volume and weight of the ammunition round 2.

In operation, the firing pin 305 strikes the base 205 of the cartridge case 20 which pinches the primer composition 261 between the cartridge case 20 and the propellant charge 22 or anvil 265. Advantageously, as the primer composition 261 is secured by the propellant charge 22, a peripheral primer cup and the associated added weight, cost and complexity are eliminated.

The weight of the lightweight ammunition round 2 is approximately 50% lighter than an equivalent conventional ammunition round. For example, the M855A1 ammunition round with an M27 metallic belt has a total weight of approximately 222 grains. The conventional brass case comprises 105 grains. The conventional propellant weighs approximately 22 grains. The projectile weighs approximately 62 grains. The conventional primer weighs approximately 3.2 grains with the primer cup and anvil accounting for approximately 3 grains. The link weighs 30 grains.

In comparison, an equivalent lightweight ammunition round 2 having a polymer cartridge case 20 and operating at a peak chamber pressure of 100,000 pounds per square inch and having a muzzle velocity equivalent to a convention M855A1 weighs approximately 97 grains. The polymer cartridge case 20 of the ammunition round 2 weighs approximately 15 grains. This is 90 grains, or approximately 86%, lighter than a conventional cartridge case. The propellant charge weighs approximately 18 grains. Note that due to the higher chamber pressures enabled by fully supporting the cartridge case 20, less propellant is required to achieve the same muzzle velocity as the conventional M855A1. The projectile weighs approximately 62 grains. The primer weighs approximately 1 grains. The polymer link weighs approximately 1 grain.

The ammunition round 2 described above is one embodiment of the invention. Individual components may be modified according to application to increase or decrease the performance. For example, the above weights are for a percussion primed cartridge case 20. Alternatively, laser ignition may be utilized to ignite the primer composition thereby negating the need for an anvil and further reducing the weight by at least 1 grain.

Figure 9:
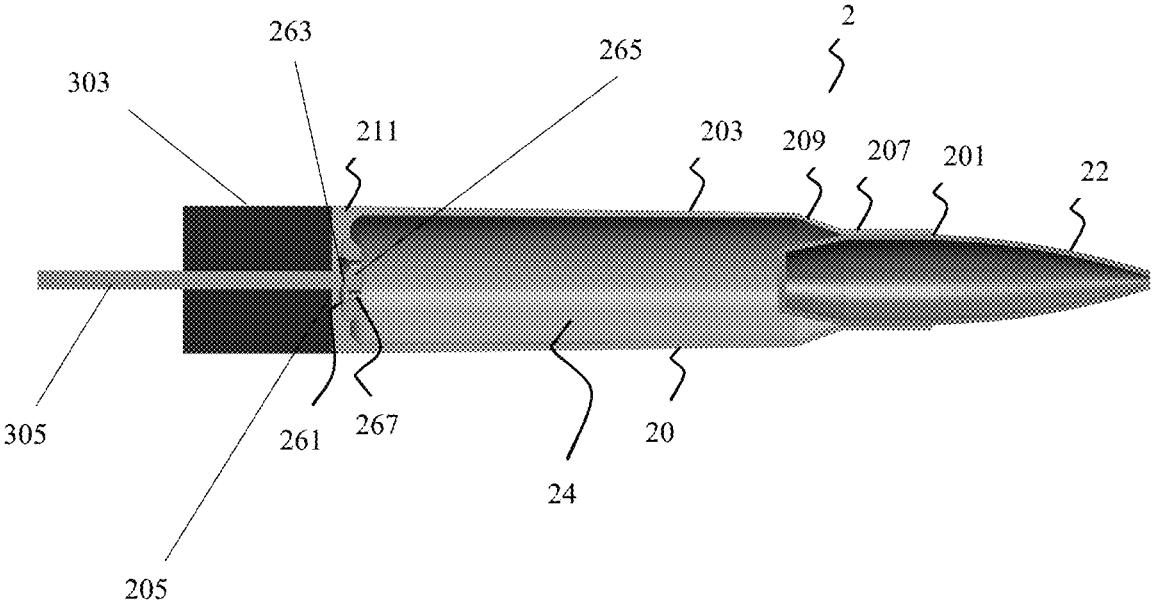
FIG. 9 is a sectional plan view of a cartridge case with an integral primer cup, in accordance with one illustrative embodiment.

FIG. 9 is a sectional plan view of a cartridge case with an integral primer cup, in accordance with one illustrative embodiment. The cartridge case 20 shown in FIG. 9 is a bottleneck cartridge having a neck region 207 and a shoulder region 209. The lightweight cartridge case 20 is devoid of a head region, rim and extraction features of conventional ammunition.

The cartridge case 20 further comprises a primer cup 263 integral to the cartridge case 20. The primer cup 263 is formed in the interior surface of the base 205 of the cartridge case 20 and holds the primer composition 26. An anvil 265 sits above the primer composition 261 and between the primer composition 261 and the propellant charge 22 and further secures the primer composition 261 in the primer cup 263. The anvil 265 is attached to the cartridge case 20 by a thread, crimp, weld, adhesive, or other means and may be made of brass, steel, aluminum, polymer or a combustible material. The anvil 265 further comprises one or more flash tubes 267 for directing the hot gases of the primer composition 261 to the propellant charge 22.

In operation, the base 205 of the cartridge case 20 is indented by the firing pin 305. The primer composition 261 is pinched between the base 205 of the cartridge case 20 and the anvil 265. Hot gases are produced by the primer composition 261 and directed to the propellant charge 22 by the flash tubes 267. As the propellant does not secure the primer composition 261 or serve as the anvil 265, the propellant may be a non-consolidated propellant.

Advantageously, the joint between the primer cup and the cartridge that exists in conventional ammunition is eliminated. This also reduces the weight associated with the conventional metallic separately loaded primer. For aluminum cartridge cases, the integral primer cup 263 eliminates the potential for "burn through" by eliminating the potential leak path at the joint between the case and the primer cup. For polymer cartridge cases, the integral primer cup eliminates the need for a primer support typically used in polymer cartridge cases, including conventional polymer cartridge cases and polymer cased telescoped cartridge cases.

Figure 10:
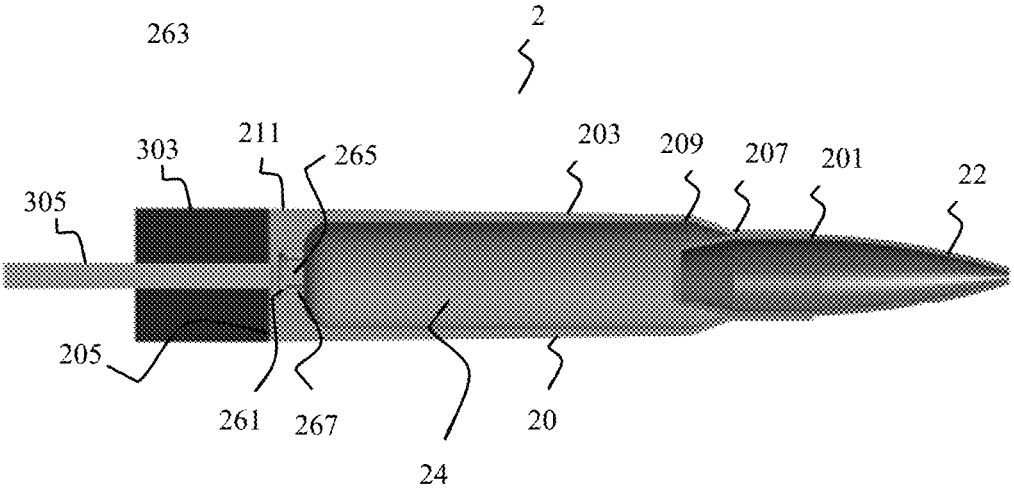
FIG. 10 is a sectional plan view of a percussion primed cartridge case with an integral primer cup, in accordance with one illustrative embodiment.

FIG. 10 is a sectional plan view of a percussion primed cartridge case 20 with an integral primer cup, in accordance with one illustrative embodiment. The cartridge case 20 shown in FIG. 10 is a polymer cartridge case 20 having an integral primer cup 263. The cartridge case 20 is a bottleneck cartridge having a neck region 207 and a shoulder region 209. While the lightweight cartridge case 20 is devoid of a rim and extraction features of conventional ammunition, the cartridge case 20 comprises a head region 211 surrounding the integral primer cup 263 and anvil 265. A recess is formed in the base 205 of the cartridge case 20 for serving as the primer cup 263 and receiving the anvil 265.

Figure 11:
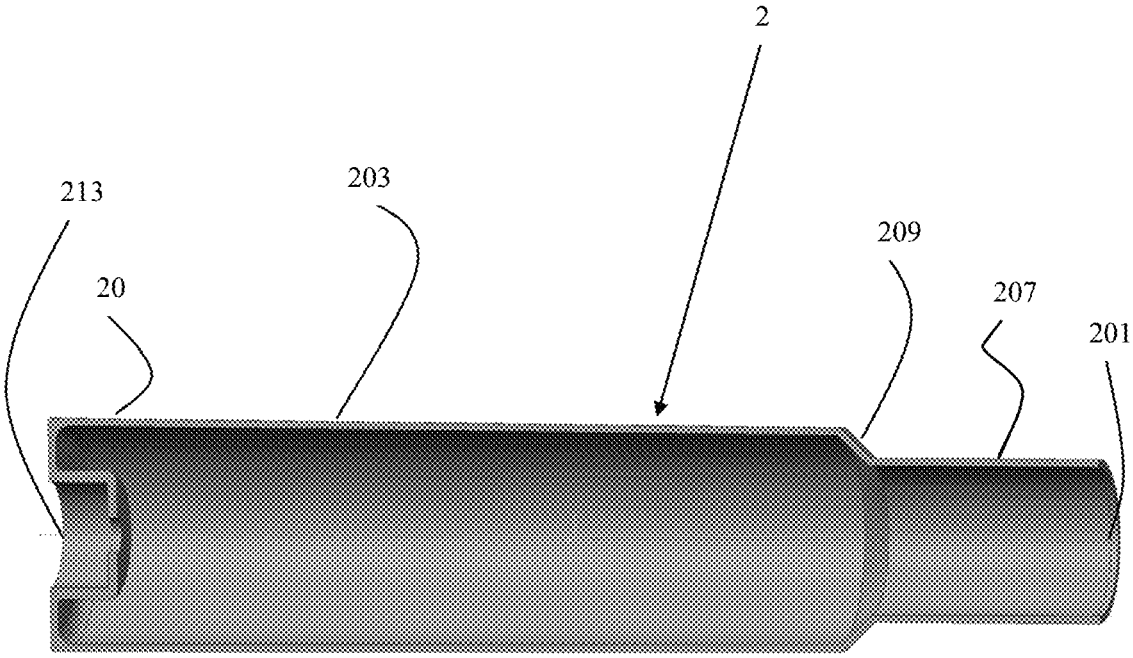
FIG. 11 is a sectional plan view of a cartridge case with a conventional primer cup, in accordance with one illustrative embodiment.

FIG. 11 is a sectional plan view of a lightweight cartridge case with a conventional primer cup, in accordance with one illustrative embodiment. The cartridge case 20 is not limited to having an integral primer cup 263. The embodiment shown in FIG. 11 is configured for receiving a peripheral primer 26 such as a Berdan primer 26.

The cartridge case 20 is a bottleneck cartridge case 20 having uniformly thin walls for the base 205 and body 203 of the cartridge case 20. The cartridge case 20 further comprises a neck region 207 and shoulder region 209 and is devoid of a head region and extraction features. A recess for receiving the primer cup 263 is defined by the outer surface of the base 205 and extends into the interior cavity of the cartridge case 20. Unlike conventional cartridge cases, the primer cup recess 213 is not surrounded by a head region of the cartridge case 20. An opening is formed in the base 205 of the primer cup recess 213 thereby allowing the gases of the primer to interact with the propellant charge 24 of the interior cavity.

Figure 12A:
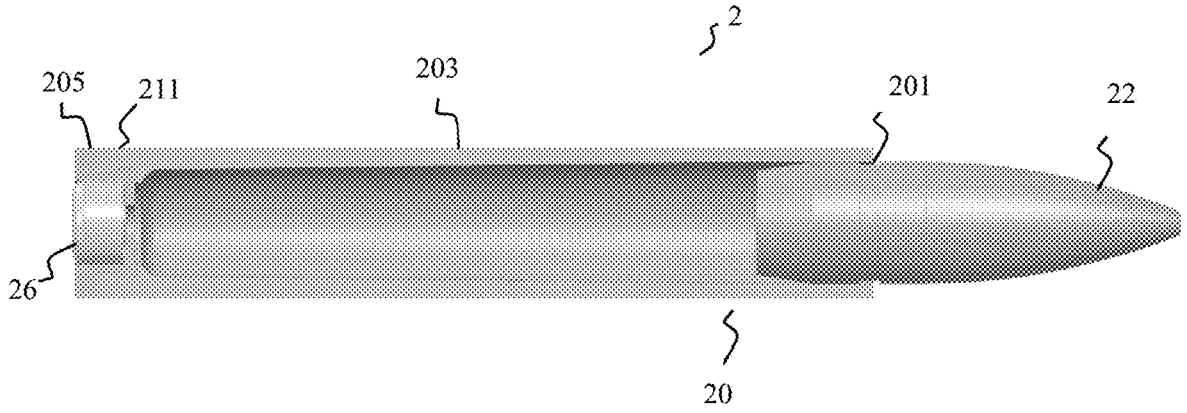
FIG. 12 includes FIG. 12*a* which is a sectional plan view of a cartridge case with a conventional primer cup and non-tapered walls and 12*b* which is a sectional perspective view of a cartridge case with conventional primer cup and non-tapered walls, in accordance with one illustrative embodiment.
Figure 12B:
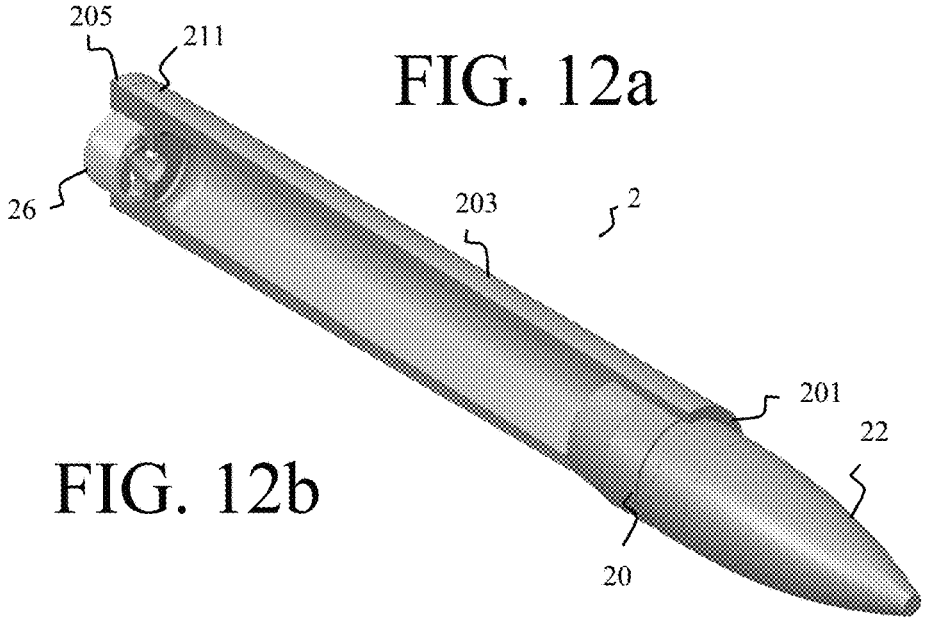

FIG. 12 includes FIG. 12*a* which is a sectional plan view of a cartridge case 20 with a conventional primer and non-tapered walls and 12*b* which is a sectional perspective view of a cartridge case 20 with conventional primer and non-tapered walls, in accordance with one illustrative embodiment. The cartridge case 20 shown in FIG. 12*a* and FIG. 12*b* is a straight wall cartridge case 20 having a base 205 configured for receiving a peripheral primer 26.

The cartridge case 20 comprises a body region 203 having thin walls, a head region 211 and a base 205. There is an opening in the head for receiving a base 205 and the interior surface of the head region 211 has mating features for interfacing with and connecting to a peripheral base 205 of the cartridge case 20. The base 205 and head region 211 may be of the same material or may be different materials.

The base 205 comprises reciprocal mating features for interfacing and connecting to the head region 211 and is further configured for receiving a peripheral primer 26, such as a Berdan primer. The base 205 comprises a recess defined by the outer facing surface of the base 205 for receiving the primer 26. An opening is formed in the base of the primer cup recess 213 thereby allowing the gases of the primer composition to interact with the propellant charge 24 of the interior cavity.

Figure 13A:
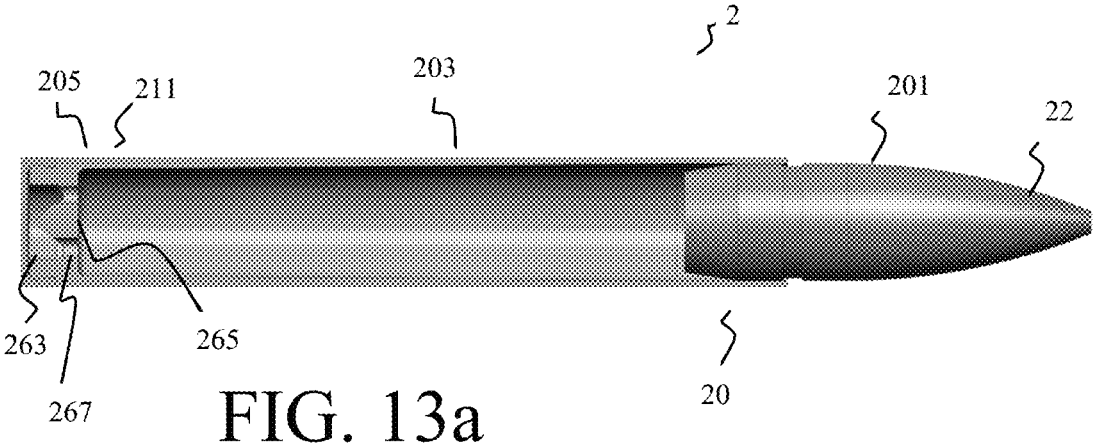
FIG. 13 includes FIG. 13*a* which is a sectional plan view of a cartridge case with a hybrid cartridge case and a metal base and FIG. 13*b* which is a sectional perspective view of a cartridge case with a hybrid cartridge case and a metal base, in accordance with one illustrative embodiment.
Figure 13B:
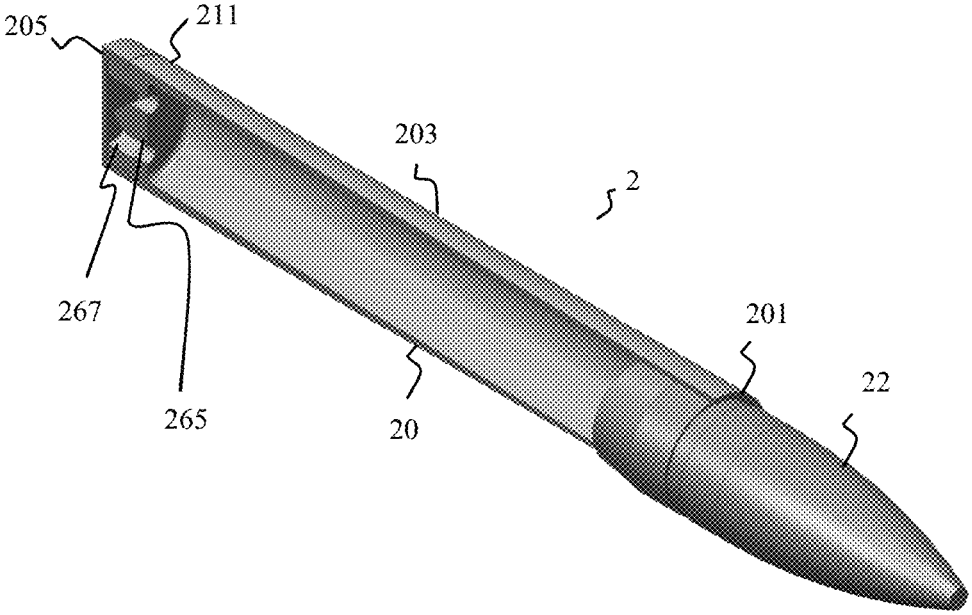

FIG. 13 is a sectional plan view of a cartridge case with a hybrid cartridge case and a metal base, in accordance with one illustrative embodiment. In the embodiment shown in FIG. 13, the cartridge case 20 is a straight-walled case having a polymer body region 203 and head region 211 and a metal base 205. The body region 203 comprises thin walls and defines the inner cavity of the cartridge case 20.

The head region 211 extends from the cartridge case 20 forming the base of the interior cavity further defines the primer cup 263. A primer cup recess 213 is formed in the head region 211 defined by the bottom surface of the head 211 and extended axially into the head region 211. The head region 211 further comprises integrally formed primer features including an anvil 265 and one or more flash tubes 267. The head 211 is dimensioned for being partially inserted into the metal base 205. The base 205 of the cartridge case 20 is a hollow metal cylinder with an opening formed in the proximate end of the cylinder.

Figure 14:
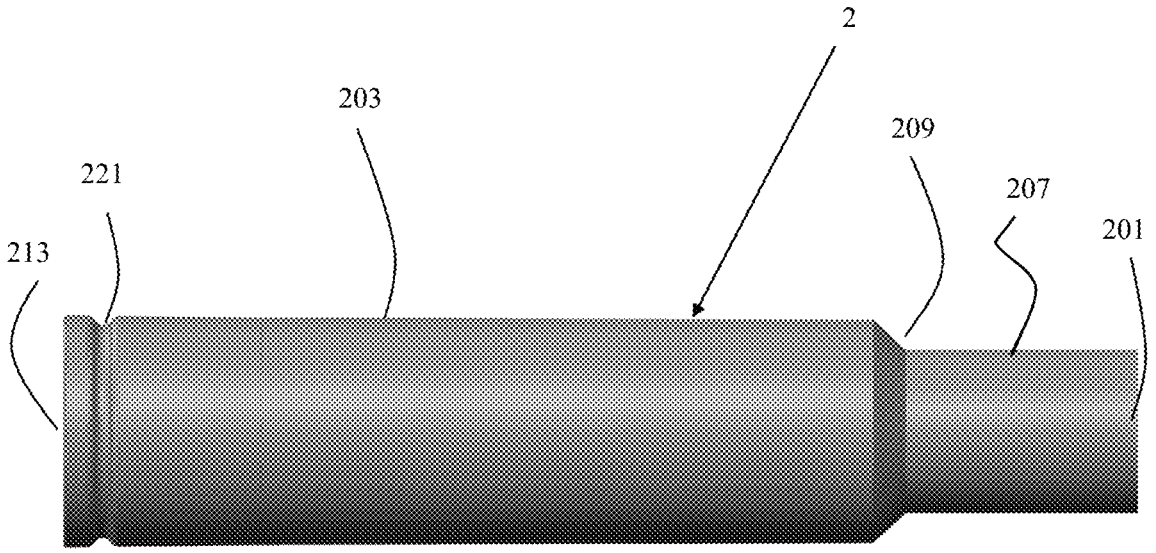
FIG. 14 is a plan view of a lightweight cartridge case with an annular groove, in accordance with one illustrative embodiment.
Figure 15:
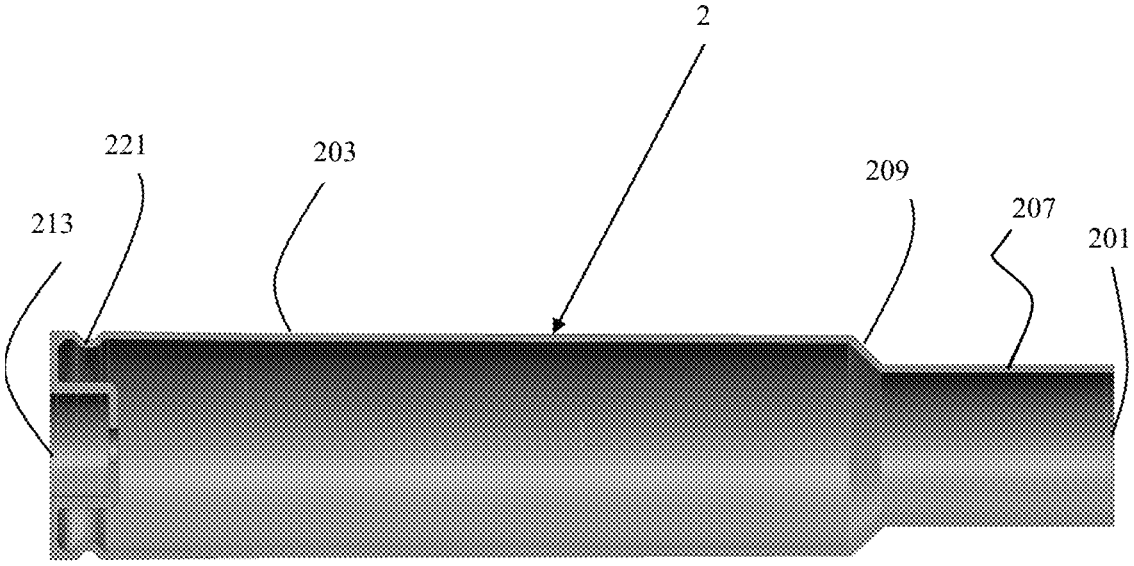
FIG. 15 is a sectional plan view of a lightweight cartridge case with an annular groove, in accordance with one illustrative embodiment.

FIG. 14 is a plan view of a lightweight cartridge case with an annular groove, in accordance with one illustrative embodiment. FIG. 15 is a sectional plan view of a lightweight cartridge case with an annular groove, in accordance with one illustrative embodiment. The ammunition round 2 may be magazine fed or belt fed into the chamber 301 of the rifle 30. For the ammunition round 2 to be belt fed by a conventional push through belt, such as an M27 ammunition belt, M13 ammunition belt or the M15 ammunition belt, an annular groove 221 is formed in the outer circumferential surface of the cartridge case 20. The annular groove 221 interfaces with a rear tab of a push through belt.

The lightweight cartridge case 20 is a bottleneck cartridge comprising a neck region 207, shoulder region 209, body region 203 and base 205. The cartridge case 20 has thin walls in each region. A recess is formed in the base 205 to receive a peripheral primer. However, in other embodiments, the primer may be integral to the cartridge case 20.

The annular groove 221 is located near the base 205 of the cartridge case 20 in place of the extractor groove found on a conventional cartridge case. The annular groove 221 may be machined into the cartridge case 20. Alternatively, the annular groove 221 may be grove rolled into the cartridge case 20. In the embodiment shown in FIG. 15, the annular groove 221 does not increase the wall thickness at the annular groove 221 thereby maintaining the weight, volume and material savings achieved by the lightweight ammunition round 2.

Figure 16:
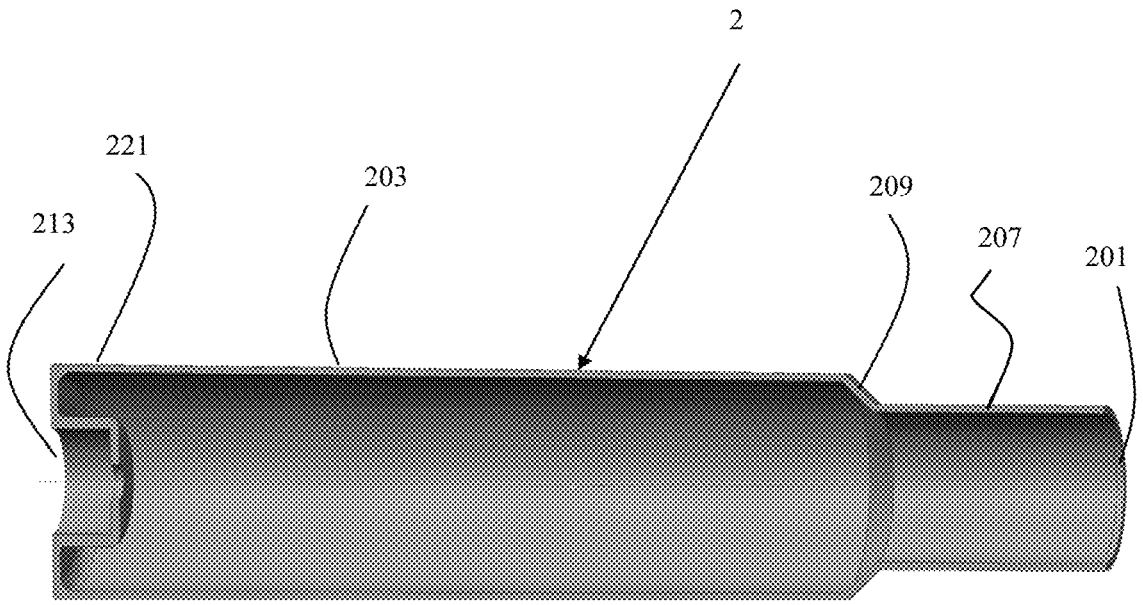
FIG. 16 is a sectional plan view of a fired lightweight cartridge case with an annular groove where the annular groove has been fire formed to the chamber dimensions, in accordance with one illustrative embodiment.

FIG. 16 is a sectional plan view of a fired lightweight cartridge case with an annular groove where the annular groove has been fire formed to the chamber 301 dimensions, in accordance with one illustrative embodiment. In operation, a straight wall body 203 may be fire formed. Subsequent to the firing of the cartridge case 20, the hot gases within the cartridge case 20 20 may provide a force against the interior cavity of the cartridge case 20 such that the annular groove 221 is deformed and the cartridge case 20 conforms to the interior geometry of the barrel chamber 301.

Figure 17:
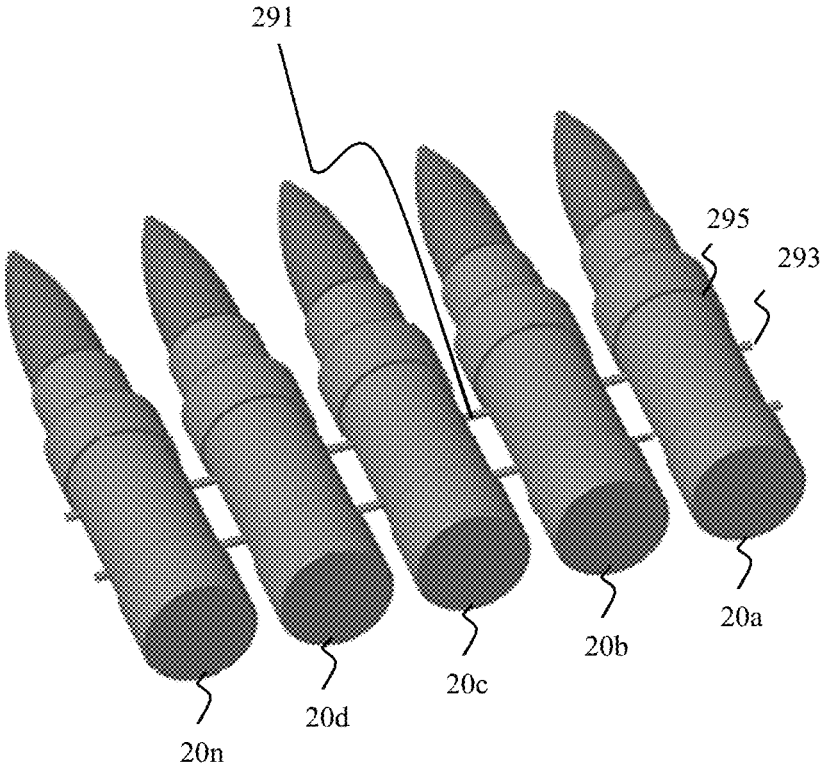
FIG. 17 is a perspective view of a cartridge case with an integral linked belt, in accordance with one embodiment.

FIG. 17 is a perspective view of a cartridge case with an integral linked belt, in accordance with one embodiment. In an embodiment of the invention, the cartridge case 20 is a polymer case with an integral linked belt 291 for linking multiple cartridge cases 20*a* . . . *n*. The integral linked belt 291 comprises one or more protrusions 293 integral to the cartridge case 20 and extending radially out from the outer circumferential surface of the cartridge case 20. Each protrusion 293 links the cartridge case 20 to another cartridge case 20. By linking a plurality of ammunition rounds 2 sequentially, an integral linked belt 291 for feeding the ammunition into the chamber 301 of the rifle 30 is formed.

In the embodiment shown in FIG. 17, each cartridge case 20 comprises four integral links 293 (i.e. protrusions 293). However, the cartridge case 20 is not limited to four integral links 293. There may be more than four links 293 or less than four links 293 dependent on the application. Two integral links 293 extend radially out from a right side of the cartridge case 20 to link the cartridge to a preceding cartridge case 20. Two integral links 293 extend radially out from the left side of the cartridge case 20 to link the cartridge case 20 to a subsequent cartridge case 20. Advantageously, the integral link belt 291 may be fed from a forward end or a back end as it is reversible.

Each protrusion 293 extends from a recessed portion 295 of the cartridge case 20 extending around the circumference of the cartridge case 20 and having a width along the axial direction of the cartridge case 20. The recessed portion 295 of the cartridge case 20 has an outer diameter that is smaller than the outer diameter of the non-recessed portions of the body 203 of the cartridge case 20. The recessed portion 295 is located at a mid-section of the body 203 of the cartridge where the cartridge case 20 is well-supported by the chamber 301 during firing. By locating it away from the base 205 or shoulder of the cartridge case 20, case failure during firing may be avoided. Additionally, the non-recessed portions of the cartridge case 20 in the axial and distal ends of the cartridge case 20 seal the chamber 301 and experience the most demanding conditions during firing.

The rifle 30 further comprises a detachment mechanism, such as a blade. During the process of feeding the ammunition round 2 into the chamber 301 of the barrel 301, the detachment mechanism cuts the relatively thin polymer protrusion 293 to separate the round about to be chambered. While the round is being chambered, the cut protrusion 293 is forced to wrap into the recessed portion of the cartridge case 20.

The protrusion 293 may be molded or co-molded to the cartridge cases 20. One preferred material for the cartridge case 20 and integral link is Radel® polyphenylsulfone (PPSU) material available from Sulvay S.A. located in Neder-Over-Heembeek, Brussels, Belgium. Radel® PPSU provides the necessary strength, flexibility and impact resistance while still being easily cut.

Figure 18:
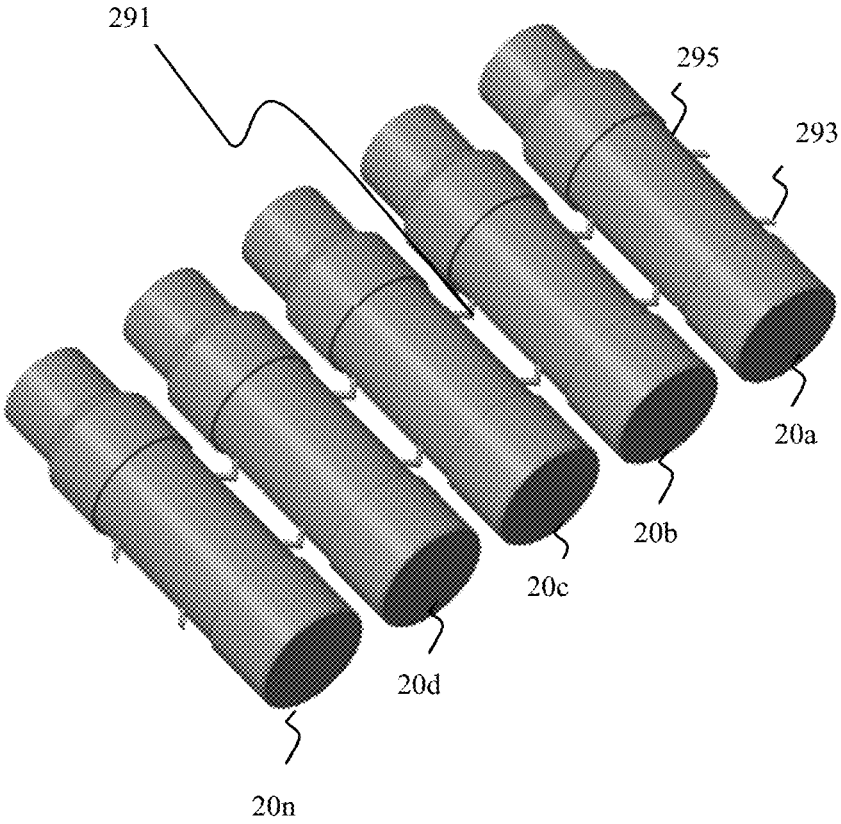
FIG. 18 is a perspective view of a cartridge case with an integral linked belt, in accordance with one embodiment.

FIG. 18 is a perspective view of a cartridge case 20 with an integral linked belt, in accordance with one embodiment. In an alternative embodiment of the case, the integral links 293 may extend out from the outer surface at an angle as opposed to radially. In the embodiment shown in FIG. 18, two integral links 293 extend from the right outer surface of the cartridge case 20 at an angle of 45 degrees with respect to a central axis of the cartridge case 20. Each of the two links is connected to an integral link 293 from a preceding cartridge case 20 thereby forming a "v" shape.

Figure 19:
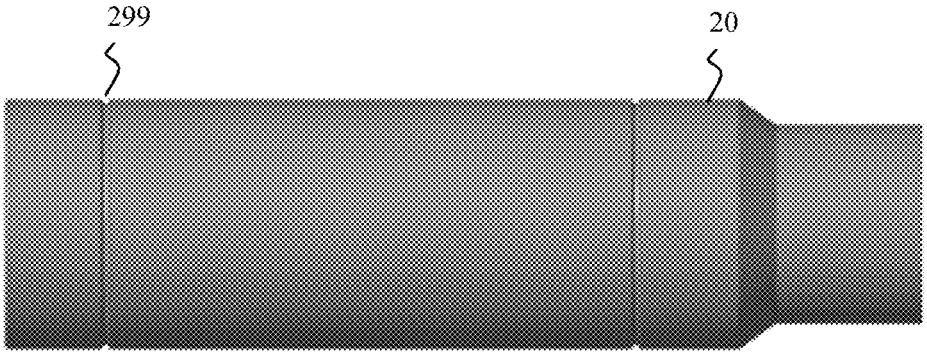
FIG. 19 is a plan view of a cartridge case configured for linking with a string, in accordance with one embodiment.

FIG. 19 is a plan view of a cartridge case 20 configured for linking with a string, in accordance with one embodiment. In an embodiment of the invention, the cartridge cases 20 are linked via a string link 297. The string 297 can be attached either during case molding or subsequent to case molding. The cartridge case 20 comprises one or more string link grooves 299 extending annularly along the outer circumferential surface of the cartridge case 20. The one or more grooves 299 are employed to secure the string link 297 in the proper location for the link configuration that is attached after the case is molded.

A weak point can be engineered at the midpoint in the string link 297 between cartridges. The weak point may be a knot in the string or may be a laser cut.

Advantageously, the string link 297 is more flexible, stronger and lighter than a link made from the cartridge case 20 material. Additionally, the string 297 is received into the annular grooves 299 thereby providing a smoother outer profile to aid chambering of the ammunition round 2.

In the embodiment shown in FIG. 19, the cartridge case 20 comprises two annular string link grooves 299. The outer diameter of the body 203 of the cartridge case 20 is uniform except for the two annular grooves 299.

Figure 20:
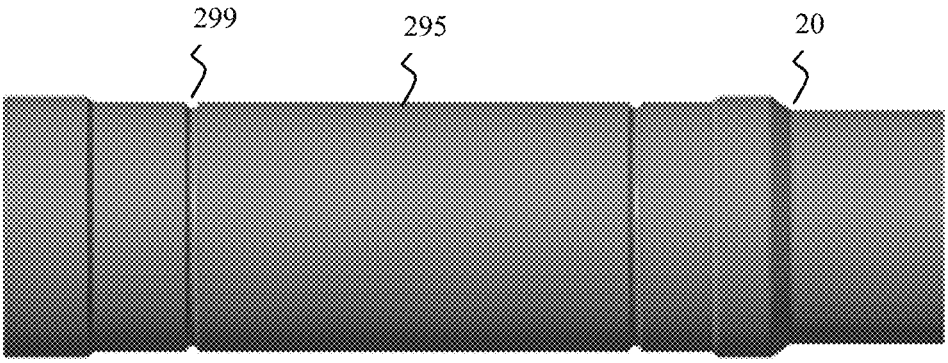
FIG. 20 is a plan view of a cartridge case configured for linking with a string, in accordance with one embodiment.

FIG. 20 is a plan view of a cartridge case 20 configured for linking with a string, in accordance with one embodiment. In the embodiment shown in FIG. 20, the cartridge case 20*a* . . . *n* comprises two annular string link grooves 299. The string link grooves 299 are disposed in a recessed portion 295 of the body 203 having an outer diameter smaller than the outer diameter at the front end and back end of the cartridge case 20. The recessed portion 295 may aid chambering of the round as the broken string link sits in the recess 295 and not between the chamber 301 and the cartridge case 20.

Figure 21:
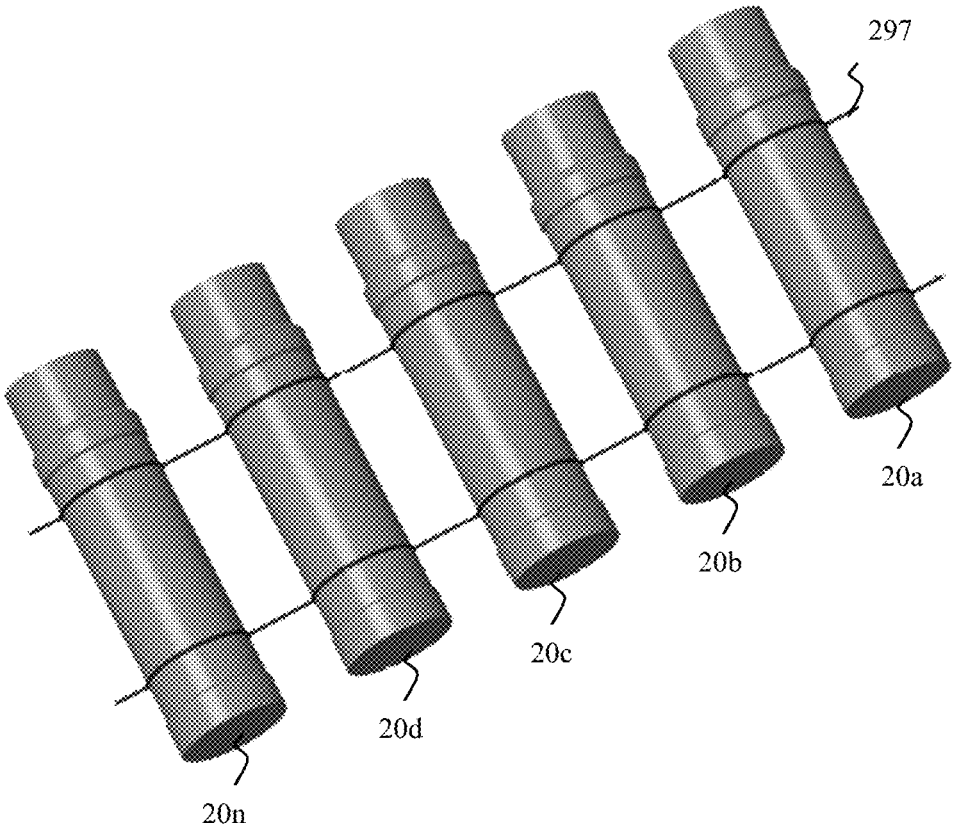
FIG. 21 is a perspective view of multiple cartridge cases linked with a string, in accordance with one embodiment.

FIG. 21 is a perspective view of multiple cartridge cases linked with a string, in accordance with one embodiment. The string links 297 connect the cartridge case 20 to a preceding and a subsequent cartridge case 20 thereby forming a belt of ammunition. Advantageously the belt may be fed from either end.

While the invention has been described with reference to certain embodiments, numerous changes, alterations and modifications to the described embodiments are possible without departing from the spirit and scope of the invention as defined in the appended claims, and equivalents thereof.

What is claimed is:

1. A rifle system comprising:

a high pressure ammunition round further comprising a cartridge case having a thin walled body region of uniform thickness extending to a base of the cartridge case, an opening at a mouth of the cartridge case for receiving a projectile, an outer surface wherein prior to firing of the ammunition round, the outer surface is substantially devoid of features configured for interfacing with a mechanical extractor, and the projectile which is partially inserted within the opening at the mouth and which comprises a front portion which protrudes beyond the cartridge case; and a rifle further comprising a barrel chamber wherein when the rifle is in a chambered state, an interior surface of the barrel chamber extends the length of the chambered cartridge case such that the entire chambered cartridge case is supported by the chamber;

a bolt seated against a base of the chambered case for sealing the barrel chamber, the bolt travelling rearward in response to a firing of the chambered cartridge case; and a rear extraction mechanism for extracting a spent cartridge case through the rear of the barrel chambered in which a residual bore pressure remaining in the chamber after the firing of the chambered cartridge case holds the spent cartridge case against the rearward travelling bolt without the bolt inserting into a cavity of the spent cartridge case.

2. The rifle system of claim 1 wherein the rear extraction mechanism of the rifle further comprises a reservoir for storing propellant gases created during the firing of the ammunition and an inlet passage for reintroducing the stored propellant gases into the chamber.

3. The rifle system of claim 2 wherein the rear extraction mechanism of the rifle further comprises an external tank holding pressurized gas for introduction into the chamber of the rifle after firing of the cartridge case.

4. The rifle system of claim 1 wherein the rear extraction mechanism of the rifle comprises a bolt having a recessed bolt face further comprising a tapered undercut wall configured for receiving an expanding cartridge case.

5. The rifle system of claim 4 wherein the cartridge case of the ammunition round is configured for expanding into the tapered undercut wall upon firing of the ammunition round.

6. The rifle system of claim 1 wherein a body region of the cartridge case extends to a base of the cartridge case.

7. The rifle system of claim 1 wherein the cartridge case is formed of a metal material.

8. The rifle system of claim 1 wherein the cartridge case is an integral unit formed of a polymer material.

9. The rifle system of claim 1 wherein the cartridge case is a bottleneck cartridge case.

* * * * *